US006992432B1

(12) United States Patent
Jansma

(10) Patent No.: US 6,992,432 B1
(45) Date of Patent: Jan. 31, 2006

(54) FLUORESCENT LAMP

(75) Inventor: Jon B. Jansma, Pepper Pike, OH (US)

(73) Assignee: General Electric Company, Schenectady, NY (US)

( * ) Notice: Subject to any disclaimer, the term of this patent is extended or adjusted under 35 U.S.C. 154(b) by 249 days.

(21) Appl. No.: 10/626,147

(22) Filed: Jul. 24, 2003

(51) Int. Cl.
*H01J 1/62* (2006.01)

(52) U.S. Cl. ..... 313/486; 313/487; 313/635; 252/301.4 R; 252/301.4 H

(58) Field of Classification Search ..... 313/483–487, 313/567, 571, 635, 639; 252/301.4 R, 301.4 H
See application file for complete search history.

(56) References Cited

U.S. PATENT DOCUMENTS 4,751,426 A * 6/1988 Hoffman et al. ..... 313/487
5,122,710 A * 6/1992 Northrop et al. ..... 313/487
5,166,456 A * 11/1992 Yoshino ..... 252/301.4 S
5,602,444 A 2/1997 Jansma
5,838,100 A 11/1998 Jansma
5,838,101 A * 11/1998 Pappalardo ..... 313/487
5,944,572 A 8/1999 Soules et al.
6,452,324 B1 9/2002 Soules et al.
6,472,812 B2 * 10/2002 Vose et al. ..... 313/486
6,525,460 B1 2/2003 Soules et al.
6,528,938 B1 3/2003 Jansma

* cited by examiner

*Primary Examiner*—Karabi Guharay
*Assistant Examiner*—German Colón
(74) *Attorney, Agent, or Firm*—Pearne & Gordon LLP

(57) ABSTRACT

A mercury vapor discharge lamp having a barrier layer and a single phosphor layer. The phosphor layer comprises 10–50 weight percent halophosphors and 50–90 weight percent rare earth phosphors. The lamp has an Ra value of 70–81, more preferably 70–79, more preferably 75–79.

15 Claims, 1 Drawing Sheet

FLUORESCENT LAMP

FIELD OF THE INVENTION

The present invention relates generally to fluorescent lamps and more particularly to a fluorescent lamp having a barrier layer and an improved phosphor layer.

DESCRIPTION OF RELATED ART

There are two principal types of phosphors used in fluorescent lamps: relatively inexpensive halophosphors and relatively expensive rare earth phosphors. Halophosphors, though commonly used due to their low cost, exhibit poorer color rendering properties and lower lumens compared with more expensive rare earth phosphors. Rare earth phosphors, for example blended into a rare earth triphosphor layer as is known in the art, exhibit excellent color rendering properties and relatively high lumens.

The fluorescent lighting industry provides certain medium performance lamps which have a barrier layer, preferably of alumina particles, coated onto the inside of the glass envelope, a halophosphor layer coated onto the barrier layer, and a rare earth triphosphor layer coated onto the halophosphor layer. As known in the art, the barrier layer blocks UV emission from the fluorescent lamp by reflecting unconverted UV radiation back toward the interior of the lamp where it is subsequently converted to visible light by the phosphors. The barrier layer also minimizes mercury loss due to reaction with the glass envelope.

However, this lamp design has drawbacks. The rare earth phosphor layer is very thin, and it is difficult to control its thickness. The thickness of this layer is strongly related to the Color Rendering Index (CRI) or Ra and lumen output. Having two layers of phosphors also increases manufacturing difficulties, production costs, equipment usage, labor usage and production losses.

Another popular fluorescent lamp design has a barrier layer coated inside the glass envelope, and only one phosphor layer coated on the barrier layer, this being a conventional rare earth triphosphor blend. However, to provide a lamp of this design which yields a luminous output of about 2800 lumens at 100 hrs for a standard 4 foot F32T8 lamp, the rare earth triphosphor blend layer is extremely thin. It is believed that this results in a lamp which does not fully or sufficiently utilize the available UV produced by the arc discharge. In addition, this lamp fails to yield CRI or Ra values in the 70s, which may be desirable in some cases.

Accordingly, there is a need for a fluorescent lamp having a barrier layer and only one phosphor layer, which more efficiently makes use of the available UV in providing lumen output and which yields CRI or Ra values in the 70s and up to about or not more than 81.

SUMMARY OF THE INVENTION

A mercury vapor discharge lamp comprising a light-transmissive envelope having an inner surface, means for providing a discharge, a discharge-sustaining fill gas sealed inside said envelope, a phosphor layer inside said envelope and adjacent the inner surface of said envelope, and a barrier layer between the envelope and the phosphor layer, said phosphor layer comprising 10–50 weight percent halophosphors and 50–90 weight percent rare earth phosphors, said weight percents being based on the total phosphor weight of said phosphor layer, said lamp having an Ra value of 70–81.

DETAILED DESCRIPTION OF THE PREFERRED EMBODIMENTS OF THE INVENTION

Figure 1:
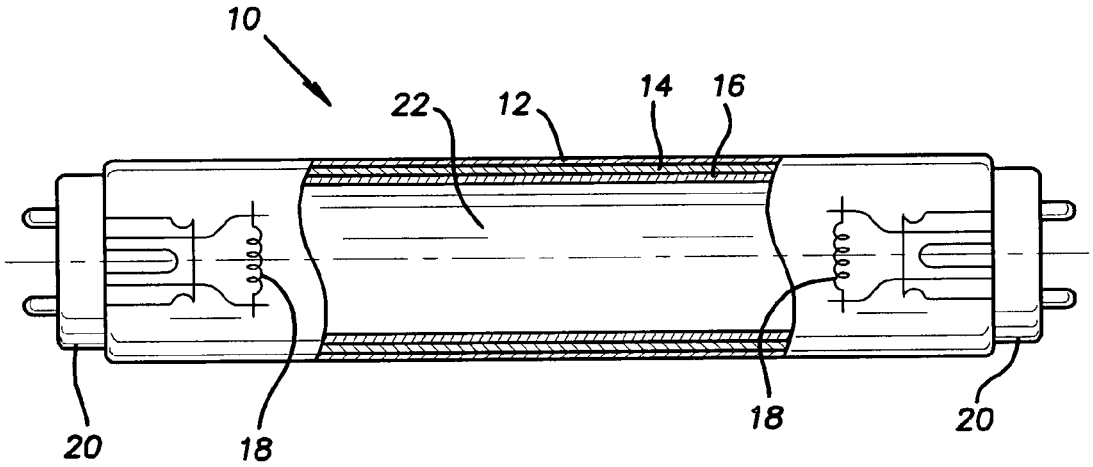
FIG. 1 shows diagrammatically, and partially in section, a fluorescent lamp according to the present invention.

In the description that follows, when a preferred range, such as 5 to 25 (or 5–25), is given, this means preferably at least 5, and separately and independently, preferably not more than 25. As used herein, a "fluorescent lamp" is any mercury vapor discharge fluorescent lamp as known in the art, including fluorescent lamps having electrodes, and electrodeless fluorescent lamps where the means for providing a discharge include a radio transmitter adapted to excite mercury vapor atoms via transmission of an electromagnetic signal. Also as used herein, a "T8 lamp" is a fluorescent lamp as known in the art, preferably linear, preferably nominally 48 inches in length, and having a nominal outer diameter of 1 inch (eight times ⅛ inch, which is where the "8"in "T8" comes from). Less preferably, the T8 fluorescent lamp can be nominally 2, 3, 6 or 8 feet long, less preferably some other length.

With reference to FIG. 1, there is shown a representative low pressure mercury vapor discharge fluorescent lamp 10, which is generally well-known in the art. The fluorescent lamp 10 has a light-transmissive glass tube or envelope 12 that has a circular cross section. Though the lamp in FIG. 1 is linear, the invention may be used in lamps of any shape and any cross section. The inner surface of the envelope 12 is provided with an ultraviolet reflecting barrier layer 14. The inner surface of the barrier layer 14 is provided with a phosphor layer 16 according to the present invention, the barrier layer 14 being between the envelope 12 and the phosphor layer 16. The invented lamp has only one phosphor layer; it does not have a second phosphor layer.

The fluorescent lamp 10 is hermetically sealed by bases 20 attached at both ends and, in lamps having electrodes (such as in FIG. 1), a pair of spaced electrodes or electrode structures 18 (to provide an arc discharge) are respectively mounted on the bases 20. The pair of spaced electrodes is a means for providing a discharge. A discharge-sustaining fill gas 22 is provided inside the sealed glass envelope, the fill gas being typically an inert gas such as argon or a mixture of argon and other noble gases such as krypton at a low pressure in combination with a small quantity of mercury to provide the low vapor pressure manner of lamp operation. The invention may also be used in electrodeless fluorescent lamps as known in the art, where the means for providing a discharge is a structure which provides high frequency electromagnetic energy or radiation.

The barrier layer 14 is a conventional barrier layer as known in the art which does not contain phosphors, such as the barrier layers described in U.S. Pat. No. 5,602,444. Barrier layer 14 can be silica or yttrium oxide as known in the art, or more preferably alumina as known in the art. When the barrier layer is alumina its coating weight is preferably 0.2–0.8, more preferably about 0.4, $mg/cm^2$.

The phosphor layer 16 is a blend of halophosphors and rare earth phosphors. As is known in the art, the phosphor layer 16 may optionally contain less than 1 or less than 2 weight percent (based on the total weight of phosphor) very finely divided alumina as an adherence additive. Otherwise, the phosphor layer 16 does not contain, and is substantially free from the presence of, barrier layer material such as the alumina used in barrier layer 14, since this is unnecessary due to the presence of barrier layer 14. The phosphor in the phosphor layer 16 is 10–50, more preferably 20–40, more preferably 25–35, more preferably 27–33, weight percent (based on total phosphor weight) halophosphor and 50–90, more preferably 60–80, more preferably 65–75, more preferably 67–73, weight percent (based on total phosphor weight) rare earth phosphor. Also preferably the phosphor layer 16 is 10–50, more preferably 20–40, more preferably 25–35, more preferably 27–33, weight percent (based on total weight of layer 16 as the lamp is sold) halophosphor and 50–90, more preferably 60–80, more preferably 65–75, more preferably 67–73, weight percent (based on total weight of layer 16 as the lamp is sold) rare earth phosphor.

The halophosphor is preferably calcium fluoro-, chlorophosphate (halophosphate) activated with manganese and antimony wherein manganese is 0.1–5, more preferably 1–4, more preferably 1.5–3.5, more preferably 2–3, more preferably about 2.2, mole percent of the halophosphor and antimony is 0.2–5, more preferably 0.5–4, more preferably 0.8–3, more preferably 1–2.5, more preferably 1–2, more preferably about 1.6, mole percent of the halophosphor. For example, for designing a 730 lamp, a halophosphate with color temperature about 3000K known as warm white, can be used. White halophosphate is preferred for a 735 lamp and cool white halophosphate is preferred for a 740 lamp. Alternatively a cool white halophosphate can be blended with YEO and LAP to produce a lamp with a color temperature of 3000K, SP30 or 730. Alternatively, other halophosphor particles known in the art may be used. The halophosphor particles are preferably provided having a narrow particle size distribution and substantially uniform shape, without complex structural features that would tend to reflect ultraviolet (UV) radiation away from the phosphor particles. The halophosphor particles are preferably 7–13, more preferably 8–12, more preferably 9–11, more preferably about 10, micrometers in diameter or at least have a median particle size or diameter within those ranges and preferably contain less than 5, 4, 3, 2, 1 or 0.5 weight percent fines (particles having a diameter of 5 micrometers or less).

The preferred rare earth phosphors are as follows. For red-emitting, yttrium oxide activated with europium (YEO) is preferred and strontium red (SR) is less preferred. For green-emitting, lanthanum phosphate activated with cerium and terbium (LAP) is preferred, aluminum oxide activated with cerium and terbium (CAT) is less preferred, and cerium borate activated with terbium (CBT) is even less preferred. For blue-emitting, strontium, calcium, barium chlorapatite activated with europium (SECA) is preferred and alkaline earth metal (such as barium) aluminate activated with europium (BAM) is less preferred. Other rare earth phosphors may be used and blended as known in the art.

The rare earth phosphor particles preferably have a narrow particle size distribution and substantially uniform shape with a minimum of complex structural features that would tend to reflect UV radiation away from the phosphor particles. The rare earth phosphor particles are preferably 1–7, more preferably 2–6, more preferably 3–6, more preferably 3–5, micrometers in diameter or at least have a median particle size or diameter within those ranges and preferably have a particle density of 4–5.5, more preferably about 5, g/cm$^3$.

In the invented phosphor layer 16, there are halophosphors and rare earth phosphors. Based on the total weight of rare earth phosphors in layer 16, the rare earth phosphors are preferably 33–60, more preferably 42–56, more preferably about 50, weight percent red-emitting, preferably 25–40, more preferably 30–38, more preferably about 35, weight percent green-emitting, and preferably 5–30, more preferably 10–23, more preferably about 15, weight percent blue-emitting. Generally, the rare earth phosphor blend used in layer 16 can be rare earth phosphor blends, preferably rare earth triphosphor blends, as known in the art.

To provide the preferred phosphor layer 16, sufficient halophosphor is added to the rare earth phosphors to provide a fluorescent lamp 10 which has a CRI or Ra value of 70–81, more preferably 70–80, more preferably 70–79, more preferably 73–79, more preferably 75–79, more preferably 78–79, more preferably 78, alternatively 78–81 or 78–80. In certain cases it is desirable to provide lamps with these Ra values to differentiate from other lamps having higher or different Ra values, while reducing cost of materials and maintaining luminous output. The blend of red, green and blue rare earth phosphors is adjusted to achieve the desired color chromaticity values, preferably for the five main lamp colors, which are as follows. For 3000K, x=0.440 and y=0.430; for 3500K, x=0.411 and y=0.393; for 4000K/4100K, x=0.380 and y=0.380; for 5000K, x=0.346 and y=0.359; for 6500K, x=0.313 and y=0.337.

Preferably 20–40 or 25–35 weight percent halophosphor is blended with 60–80 or 65–75 weight percent of a rare earth red, green, blue triphosphor blend (preferably YEO, LAP and SECA in their relative weight percents noted above for red, green and blue-emitting phosphors) to yield the final phosphor blend. Alternatively only red and green rare earth phosphors can be used (preferably YEO and LAP or CAT), or four rare earth phosphors can be used (preferably YEO, LAP or CAT, SECA, and BAM).

Adding halophosphors to a rare earth phosphor blend tends to lower lumen output at comparable coating weights. The coating weight of the phosphor layer 16 is adjusted to achieve 2500–2900, more preferably 2600–2900, more preferably about 2800, lumens at 100 hrs for a standard 4 foot F32T8 fluorescent lamp. The coating weight of phosphor layer 16 is preferably 1–2, more preferably 1.2–1.6, more preferably about 1.4, mg/cm$^2$. The present invention is particularly useful in T5, T8, T10, T12 and CFL lamps, particularly SP products.

The barrier layer 14 and the phosphor layer 16 are blended, prepared, and applied to the glass envelope as is known and conventional in the art.

The following Example further illustrates various aspects of the invention. Halo is calcium halophosphate as mentioned above.

EXAMPLE 1

A test was conducted to compare (1) a lamp of the prior art wherein the phosphor layer 16 contains the conventional rare earth trisphosphor blend, with (2) a lamp according to the present invention. The results are tabulated below.

| Lamp type | Nominal Color Temperature | Weight of Alumina in Barrier Layer | Phosphor Weight Composition of Phosphor Layer | x | y | Ra | 100 hr lumens/W |
|---|---|---|---|---|---|---|---|
| F32T8 SP41 lamp of the prior art | 4100 K. | 400 mg | 0.63 g YEO<br>0.39 g LAP<br>0.14 g SECA | 0.381 | 0.382 | 82 | 82.8 |
| F32T8 SP41 lamp with invented phosphor layer | 4100 K. | 400 mg | 0.39 g Halo<br>0.50 g YEO<br>0.30 g LAP<br>0.11 g SECA | 0.381 | 0.384 | 77 | 82.5 |

As can be seen, when the invented phosphor formulation was used, the amount of expensive rare earth phosphors was able to be substantially reduced, the desired color chromaticity values were able to be substantially maintained, the desired luminous output was able to be maintained, while the desired Ra value in the 70s was able to be achieved. These results were surprising and unexpected.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A mercury vapor discharge lamp comprising a light-transmissive envelope having an inner surface, means for providing a discharge, a discharge-sustaining fill gas sealed inside said envelope, a phosphor layer inside said envelope and adjacent the inner surface of said envelope, and a barrier layer between the envelope and the phosphor layer, said phosphor layer comprising 10–50 weight percent halophosphors and 50–90 weight percent rare earth phosphors, said weight percents being based on the total phosphor weight of said phosphor layer, said halophosphors being activated by one or more of the group consisting of antimony and manganese, said lamp having an Ra value of 70–81.

2. The lamp of claim 1, wherein said phosphor layer comprises 10–50 weight percent halophosphors and 50–90 weight percent rare earth phosphors, said weight percents being based on the total weight of said phosphor layer, said halophosphors being activated by one or more of the group consisting of antimony and manganese.

3. The lamp of claim 1, said phosphor layer comprising 20–40 weight percent halophosphors and 60–80 weight percent rare earth phosphors, said weight percents being based on the total phosphor weight of said phosphor layer, said halophosphors being activated by one or more of the group consisting of antimony and manganese.

4. The lamp of claim 2, said lamp having an Ra value of 70–79.

5. The lamp of claim 2, said lamp having an Ra value of 73–79.

6. The lamp of claim 2, said lamp having an Ra value of 75–79.

7. The lamp of claim 2, said lamp having an Ra value of 78–79.

8. The lamp of claim 2, the rare earth phosphors in said phosphor layer being a rare earth triphosphor blend, the weight percents of said rare earth phosphors, based on the total weight of rare earth phosphors in said phosphor layer, being 33–60 weight percent red-emitting, 25–40 weight percent green-emitting, and 5–30 weight percent blue-emitting.

9. The lamp of claim 2, said phosphor layer and said barrier layer being such that, when provided in a standard 4 foot F32T8 fluorescent lamp, they yield 2600–2900 lumens at 100 hrs.

10. The lamp of claim 2, said phosphor layer having a coating weight of 1–2 mg/cm$^2$.

11. The lamp of claim 2, said halophosphors being calcium halophosphate activated with manganese and antimony and wherein said rare earth phosphors comprises YEO and SECA.

12. The lamp of claim 2, said lamp having no more than one phosphor layer.

13. The lamp of claim 2, said phosphor layer comprising 25–35 weight percent halophosphors and 65–75 weight percent rare earth phosphors, said weight percents being based on the total phosphor weight of said phosphor layer, said halophosphors being activated by one or more of the group consisting of antimony and manganese.

14. The lamp of claim 2, said phosphor layer and said barrier layer being such that, when provided in a standard 4 foot F32T8 fluorescent lamp, they yield about 2800 lumens at 100 hrs.

15. The lamp of claim 2, said phosphor layer having a coating weight of 1.2–1.6 mg/cm$^2$.

* * * * *